US011959675B2

(12) United States Patent
Watanabe et al.

(10) Patent No.: US 11,959,675 B2
(45) Date of Patent: Apr. 16, 2024

(54) AIR-CONDITIONING APPARATUS

(71) Applicant: Mitsubishi Electric Corporation, Tokyo (JP)

(72) Inventors: Kazuki Watanabe, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 490 days.

(21) Appl. No.: 17/273,418

(22) PCT Filed: Nov. 28, 2018

(86) PCT No.: PCT/JP2018/043715

§ 371 (c)(1),
(2) Date: Mar. 4, 2021

(87) PCT Pub. No.: WO2020/110216

PCT Pub. Date: Jun. 4, 2020

(65) Prior Publication Data

US 2021/0199360 A1 Jul. 1, 2021

(51) Int. Cl.

| | |
|---|---|
| ***F25B 49/02*** | (2006.01) |
| ***F24F 11/36*** | (2018.01) |
| ***F24F 11/89*** | (2018.01) |

(52) U.S. Cl.

CPC ..... *F25B 49/02* (2013.01); *F24F 11/36* (2018.01); *F24F 11/89* (2018.01); (Continued)

(58) Field of Classification Search

CPC ..... F25B 49/02; F25B 2500/222; F25B 2600/2513; F25B 11/52; F25B 11/526; F25B 11/36; F25B 11/89

See application file for complete search history.

(56) References Cited

U.S. PATENT DOCUMENTS

2006/0026972 A1 2/2006 Masui et al.

FOREIGN PATENT DOCUMENTS

AU 2015277826 A1 * 1/2017 ..... F24F 1/0007
EP 2 589 900 A1 5/2013

(Continued)

OTHER PUBLICATIONS

Office Action dated Oct. 19, 2021, issued in corresponding JP Patent Application No. 2020-557448 (and English Machine Translation).

(Continued)

*Primary Examiner* — Kun Kai Ma

(74) *Attorney, Agent, or Firm* — POSZ LAW GROUP, PLC

(57) ABSTRACT

An air-conditioning apparatus includes an indoor unit and an outdoor unit connected to each other via a refrigerant pipe through which refrigerant flows. The air-conditioning apparatus includes a refrigerant sensor that detects leakage of the refrigerant in the indoor unit, a notification unit that provides a notification of occurrence of leakage of the refrigerant, a transmitter that communicates with an external terminal via a network, and a controller that controls the notification unit and the transmitter. The notification unit includes a display and a speaker disposed on a surface of a casing of the indoor unit, and the external terminal. When leakage of the refrigerant is detected by the refrigerant sensor, the controller controls the notification unit and the transmitter to provide a notification of occurrence of leakage of the refrigerant.

12 Claims, 5 Drawing Sheets

(52) U.S. Cl.
CPC . *F25B 2313/0314* (2013.01); *F25B 2500/222* (2013.01); *F25B 2600/2513* (2013.01)

(56) References Cited

FOREIGN PATENT DOCUMENTS

| | | | | | |
|---|---|---|---|---|---|
| GB | 2547583 | A | | 8/2017 | |
| JP | 2006-337021 | A | | 12/2006 | |
| JP | 2015-114031 | A | | 6/2014 | |
| JP | 2016-070568 | A | | 5/2016 | |
| JP | 2016-223650 | A | | 12/2016 | |
| JP | 2017-032251 | A | | 2/2017 | |
| JP | 2017-053509 | A | | 3/2017 | |
| JP | 2017053509 | A | * | 3/2017 | |
| KR | 20140099747 | A | * | 8/2014 | ..... F24F 1/32 |
| WO | 2016/088167 | A1 | | 6/2016 | |
| WO | WO-2018011994 | A1 | * | 1/2018 | ..... F24F 11/36 |
| WO | 2018/154652 | A1 | | 8/2018 | |
| WO | WO-2018147235 | A1 | * | 8/2018 | ..... F24F 11/46 |
| WO | WO-2018154652 | A1 | * | 8/2018 | |

OTHER PUBLICATIONS

International Search Report of the International Searching Authority dated Dec. 25, 2018 for the corresponding International application No. PCT/JP2018/043715 (and English translation).
Office Action dated Aug. 11, 2023 issued in corresponding DE patent application No. 11 2018 008 171.0 (and English translation).

* cited by examiner

AIR-CONDITIONING APPARATUS

CROSS REFERENCE TO RELATED APPLICATION

This application is a U.S. national stage application of PCT/JP2018/043715 filed on Nov. 28, 2018, the contents of which are incorporated herein by reference.

TECHNICAL FIELD

The present disclosure relates to an air-conditioning apparatus provided with an indoor unit and an outdoor unit connected to each other via a refrigerant pipe through which refrigerant flows.

BACKGROUND ART

In recent years, there has been a demand to shift refrigerants for air-conditioning apparatuses to refrigerants with low global warming potential, in view of preventing global warming. Among such refrigerants, HFC32 having a lower global warming potential than HFC410A has become the mainstream refrigerant.

However, HFC32 is slightly flammable. Many other refrigerants with low global warming potential are also flammable to one degree or another. Further, it has been discussed to replace low global warming potential refrigerants with refrigerants having lower environmental load such as propane or $CO_2$ in the future, and more consideration needs to be paid to the safety.

It is assumed here that a predetermined time period has elapsed from occurrence of leakage of flammable refrigerant, without the user noticing the leakage. In this case, because the room in which the indoor unit with refrigerant leakage is installed is not ventilated and the refrigerant is not diffused, an area with high refrigerant concertation may appear due to the accumulated refrigerant. This is an emergency situation, and the user needs to be immediately notified of the leakage by some notification means in the case where the leaking refrigerant is flammable.

Conventional notification means, such as one provided in an air-conditioning apparatus disclosed in Patent Literature 1, generally notifies of leakage by turning on a lamp disposed on a decorative panel of an indoor unit, or by outputting voice or sound such as buzzer sound from a speaker disposed on the indoor unit. Other than that, there is known notification means that displays an indication for notifying of refrigerant leakage on a display unit of a remote controller for operating an indoor unit. The remote controller is provided in a room where the indoor unit is installed.

CITATION LIST

Patent Literature

Patent Literature 1: Japanese Unexamined Patent Application Publication No. 2016-223650

SUMMARY OF INVENTION

Technical Problem

According to the air-conditioning apparatus disclosed in Patent Literature 1, in the case where refrigerant leakage occurs, it is possible to provide a notification to users in the vicinity of the indoor unit with the refrigerant leakage or other indoor units. However, there is no way to provide a notification to users not in the vicinity of these indoor units.

Therefore, in the case of the air-conditioning apparatus disclosed in Patent Literature 1, if the user is not in the vicinity of the indoor unit with the refrigerant leakage, it is not possible to notify the user of the refrigerant leakage, so that the user may not become aware of occurrence of the refrigerant leakage.

Further, even if the user is in the vicinity of the indoor unit, the user may not notice a notification of the refrigerant leakage for some reason. In this case, the user is less likely to become aware of the refrigerant leakage even if the notification continues to be provided in the same form. That is, the form of notifying of refrigerant leakage is not adequate.

The air-conditioning apparatus of the present disclosure has been made to overcome the above problems, and aims to provide an air-conditioning apparatus that provides a warning notification of refrigerant leakage not only in the vicinity of an indoor unit, but also on an external terminal device to attract more attention to the notification even from a user not in the vicinity of the indoor unit such that the user easily notices the notification and becomes fully aware of the refrigerant leakage.

Solution to Problem

According to an embodiment of the present disclosure, there is provided an air-conditioning apparatus provided with an indoor unit and an outdoor unit connected to each other via a refrigerant pipe through which refrigerant flows, the air-conditioning apparatus including: a refrigerant detection unit configured to detect leakage of the refrigerant in the indoor unit; a notification unit configured to provide a notification of occurrence of leakage of the refrigerant; a communication unit capable of communicating with an external terminal device via a network; and a controller configured to control at least the notification unit and the communication unit; wherein the notification unit includes at least one of a display unit and a speaker disposed on a surface of a casing of the indoor unit, and the external terminal device, in addition to a display unit disposed on a remote controller for operating the indoor unit; and wherein when leakage of the refrigerant is detected by the refrigerant detection unit, the controller controls the notification unit and the communication unit to provide a notification of occurrence of leakage of the refrigerant.

Advantageous Effects of Invention

According to the air-conditioning apparatus of the above embodiment, a warning notification of refrigerant leakage is provided not only from the notification unit disposed on the indoor unit, but also from the external terminal device to attract more attention to the notification even from a user not in the vicinity of the indoor unit such that the user easily notices the notification and becomes fully aware of the refrigerant leakage.

DESCRIPTION OF EMBODIMENTS

Figure 1:
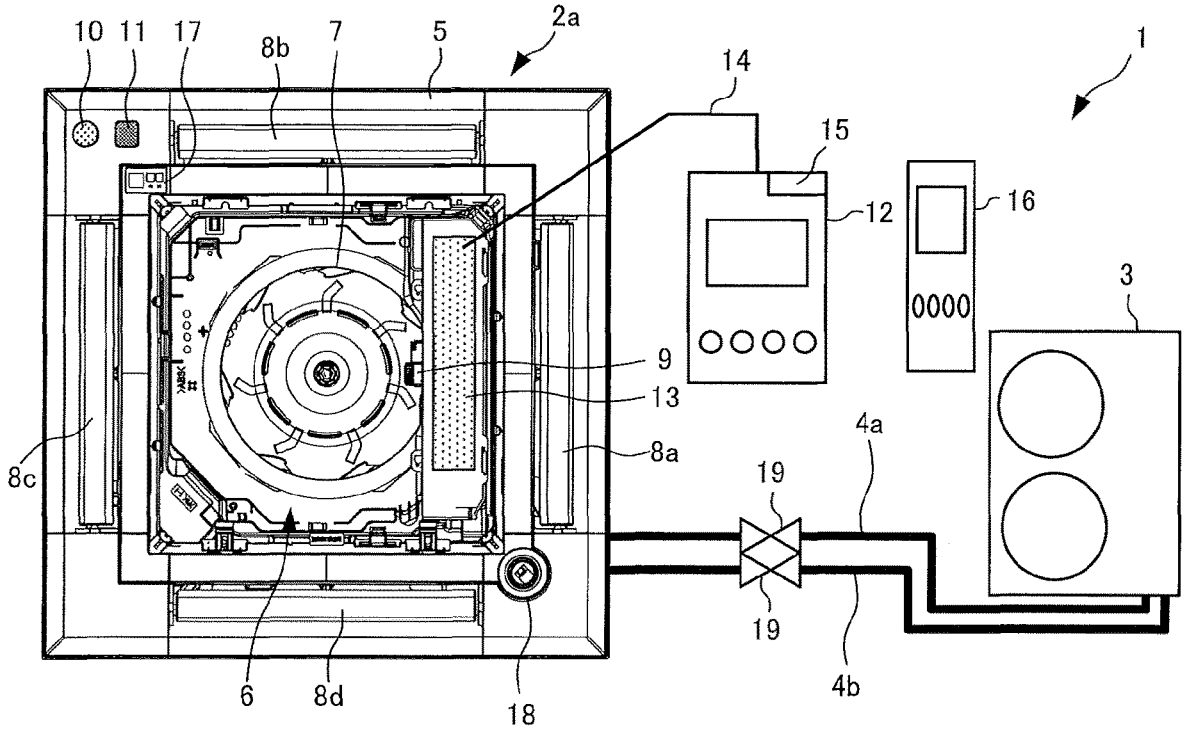
FIG. 1 is a configuration diagram illustrating an air-conditioning apparatus according to Embodiment 1 of the present disclosure.

Embodiments of the present disclosure will be described with reference to the drawings. Note that the forms of the elements described herein are merely examples, and the elements are not limited thereto. The embodiment of the present disclosure can be appropriately modified without departing from the scope or spirit of the present disclosure that can be read from the appended claims and the entire specification. Air-conditioning apparatuses with such modifications fall within the technical idea of the present disclosure. Further, in the drawings, elements denoted by the same reference signs correspond to the same or equivalent elements. This applies throughout the specification.

Embodiment 1

<Configuration of Air-Conditioning Apparatus 1>

Figure 2:
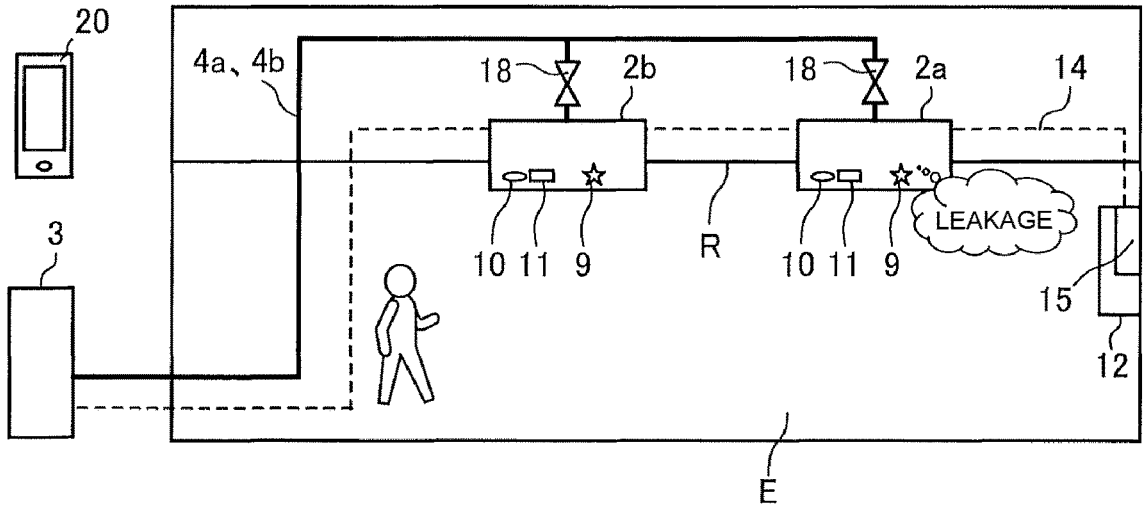
FIG. 2 is an explanatory diagram illustrating an example of installation of the air-conditioning apparatus according to Embodiment 1 of the present disclosure.

FIG. 1 is a configuration diagram illustrating an air-conditioning apparatus according to Embodiment 1 of the present disclosure. FIG. 2 is an explanatory diagram illustrating an example of installation of the air-conditioning apparatus according to Embodiment 1 of the present disclosure. As illustrated in FIGS. 1 and 2, an air-conditioning apparatus 1 of Embodiment 1 includes a plurality of indoor units 2*a* and 2*b* and an outdoor unit 3 connected to each other via refrigerant pipes 4*a* and 4*b* through which refrigerant flows. Note that one or more indoor units 2*a* and 2*b* may be provided for the outdoor unit 3. In the case of Embodiment 1, the two indoor units 2*a* and 2*b* are provided to form the multi-type air conditioning apparatus 1. Further, since the indoor units 2*a* and 2*b* have the same configuration, the drawings excluding FIG. 2 illustrate only the indoor unit 2*a*, and a description will be given of only the indoor unit 2*a* in Embodiment 1 when referring to these drawings, for purposes of convenience. Similarly, as for the refrigerant pipes 4*a* and 4*b*, FIG. 2 illustrates only the refrigerant pipe 4*a*, and a description will be given of only the refrigerant pipe 4*a* when referring to FIG. 2.

Each of the indoor units 2*a* and 2*b* is disposed on a ceiling surface R of an air-conditioned space, namely, a room E, and a decorative panel 5 is attached to the front side of a casing having a rectangular shape in a plan view. That is, each of the indoor units 2*a* and 2*b* is installed on the ceiling surface R of the single room E in such a manner that the decorative panel 5 is exposed. The decorative panel 5 is configured as a four-way air-flow type that can blow out conditioned air in four directions. Note that the indoor units 2*a* and 2*b* may be installed in the same room E, or may be installed in a plurality of different rooms. Further, one or more indoor units 2*a* and 2*b* are installed in each room. The decorative panel 5 is not limited to the four-way air-flow type, and may be a two-way air-flow type. That is, various other types of decorative panels may be used as the decorative panel 5.

Each of the indoor units 2*a* and 2*b* has an air inlet 6 for suctioning indoor air at its center portion. An air-sending device 7 is disposed at the back of the air inlet 6. The air-sending device 7 is, for example, a fan. Four air outlets for blowing out conditioned air subjected to heat exchange in four directions are disposed around the air inlet 6. The four air outlets are respectively provided with louvers 8*a* to 8*d* for controlling the air blowing direction of the conditioned air.

Each of the indoor units 2*a* and 2*b* is provided with a refrigerant sensor 9 serving as a refrigerant detection unit configured to detect refrigerant leakage. The refrigerant sensor 9 is a gas sensor configured to detect the presence of HFC32 or refrigerant gas, such as LP gas, that is likely to be used as refrigerant for environmental protection in the future, and output the concentration of the detected gas as a sensor output (ppm). The refrigerant sensor 9 may be, for example, a semiconductor gas sensor that detects gas leakage, based on a reduction in electrical resistance due to separation of oxygen atoms from a detection portion in response to contact of reducing gas with the detection portion.

Further, a display unit 10 and a speaker 11 are disposed on the decorative panel 5 of each of the indoor units 2*a* and 2*b*. Each of the display unit 10 and the speaker 11 serves as a notification unit that provides a notification of occurrence of refrigerant leakage when refrigerant leakage is detected by the refrigerant sensor 9. Although the display unit 10 is a light emitting diode (LED) in Embodiment 1, the display unit 10 is not limited thereto. The display unit 10 and the speaker 11 are disposed adjacent to each other on the decorative panel 5. With this arrangement, when providing a notification of refrigerant leakage, light from the display unit 10 and sound from the speaker 11 are emitted side by side. This allows to attract more attention from the user. Moreover, since the display unit 10 and the speaker 11 are disposed adjacent to each other, it is easy to replace parts when performing maintenance. This improves the serviceability.

Moreover, in Embodiment 1, each of the indoor units 2*a* and 2*b* is provided with a wired remote controller 12 connected to a controller 13 via the wire 14. The remote controller 12 can perform an ON/OFF operation of the indoor unit, and allows to configure the detailed settings such as temperature, air volume, air-flow direction, and timer. The remote controller 12 is connected also to the outdoor unit 3 through the wire 14.

The remote controller 12 is provided with a communication unit 15 that can communicate with an external terminal device 20 via a network. Specifically, the network between the communication unit 15 and the external terminal device 20 may be a near field communication network such as a wireless local area network (LAN) or Bluetooth (registered trademark), or any of various communication networks such as the Internet and mobile phone networks.

When the refrigerant sensor 9 detects refrigerant leakage, the controller 13 controls at least one of the display unit 10 and the speaker 11 to provide a notification of occurrence of refrigerant leakage, and also controls the external terminal device 20 to provide the notification via the communication unit 15. The external terminal device 20 may be any of various terminals, such as a personal computer, a smart phone, and a tablet terminal, that can provide a notification in the form of sound, light, or visual indication.

In the case of Embodiment 1, each of the display unit 10, the speaker 11, and the external terminal device 20 serving as a notification unit is a device that, when refrigerant leakage is detected by the refrigerant sensor 9, provides a notification of occurrence of refrigerant leakage to make the user recognize the refrigerant leakage. The display unit 10, the speaker 11, and the external terminal device 20 are connected to the controller 13 through a wire or wirelessly. When refrigerant leakage is detected by the refrigerant sensor 9, the notification described above is provided under the control of the controller 13. One method of providing a notification by the speaker 11 may be to notify the user of refrigerant leakage by, for example, outputting warning sound such as buzzer sound, or providing a voice announcement indicating the refrigerant leakage. One method of providing a notification by the display unit 10 may be to notify the user of refrigerant leakage by, for example, emitting light. The light may be emitted by turning on or blinking a lamp such as a warning lamp. The display unit 10 may notify the user of refrigerant leakage in the form of text, by displaying text indicating that there is refrigerant leakage. One method of providing a notification using both the display unit 10 and the speaker 11 may be to notify the user of refrigerant leakage by a combination of sound, light, and visual indication. One method of providing a notification using the external terminal device 20 may be to notify the user of refrigerant leakage by a combination of sound, light, and visual indication. Furthermore, the indoor unit 2*a* (2*b*) with refrigerant leakage may provide a notification in a different form from the other indoor unit 2*b* (2*a*). Providing a notification in a different form is achieved by, for example, changing the buzzer sound to be output from the speaker 11, or changing the voice message to be output from the speaker 11.

A light receiving unit 17 is provided on the decorative panel 5 of each of the indoor units 2*a* and 2*b*. The light receiving unit 17 is configured to receive an operation signal transmitted from a wireless remote controller 16 that allows to configure simple air-conditioning settings such as temperature, air volume, and air-flow direction. A human sensor 18 serving as a temperature sensor configured to detect a person in the vicinity thereof is also provided on the decorative panel 5 of each of the indoor units 2*a* and 2*b*. Note that the communication unit 15 does not have to be disposed on the remote controller 12, and may be disposed on the remote controller 16, on both the remote controllers 12 and 16, or on the decorative panel 5. The light receiving unit 17 and the human sensor 18 are disposed to face each other on the decorative panel 5. The light receiving unit 17 is disposed adjacent to the display unit 10 and the speaker 11, on the decorative panel 5. With this arrangement, since the light receiving unit 17 is disposed adjacent to the display unit 10 and the speaker 11, it is easy to replace parts when performing maintenance. This improves the serviceability. Moreover, since the display unit 10 and the speaker 11 are disposed apart from the human sensor 18, it is possible to prevent an error in temperature detection by the human sensor 18 due to the heat generated by the display unit 10 and the speaker 11.

Shutoff valves 19 are provided, one in each of the refrigerant pipes 4*a* and 4*b* respectively connecting the indoor units 2*a* and 2*b* to the outdoor unit 3. The shutoff valves 19 are configured to cut off the flow of refrigerant between the indoor unit 2*a* and the outdoor unit 3 and between the indoor unit 2*b* and the outdoor unit 3, respectively. When refrigerant leakage is detected by the refrigerant sensor 9, the shutoff valve 19 is switched from the open state to the closed state by the controller 13, thereby isolating the indoor unit 2*a* or 2*b* with refrigerant leakage.

When refrigerant leakage is detected by the refrigerant sensor 9, the air-sending device 7 of each of the indoor units 2*a* and 2*b* is forcibly operated. The term "forcibly operate" as used herein means to operate the air-sending device 7 of each of the indoor units 2*a* and 2*b* to send a strong airflow regardless of whether the air-sending device 7 is stopped or in operation. As a result, it is possible to diffuse the refrigerant leaked into the room E and prevent appearance of an area with high concentration of refrigerant due to accumulation of refrigerant. Moreover, when refrigerant leakage is detected by the refrigerant sensor 9, it is possible to prevent spread of refrigerant leakage, by performing both a forced operation of the air-sending device 7 of each of the indoor units 2*a* and 2*b* and isolation of the indoor unit 2*a* or 2*b* with refrigerant leakage by the shutoff valve 19.

<About Refrigerant Circuit>

Figure 3:
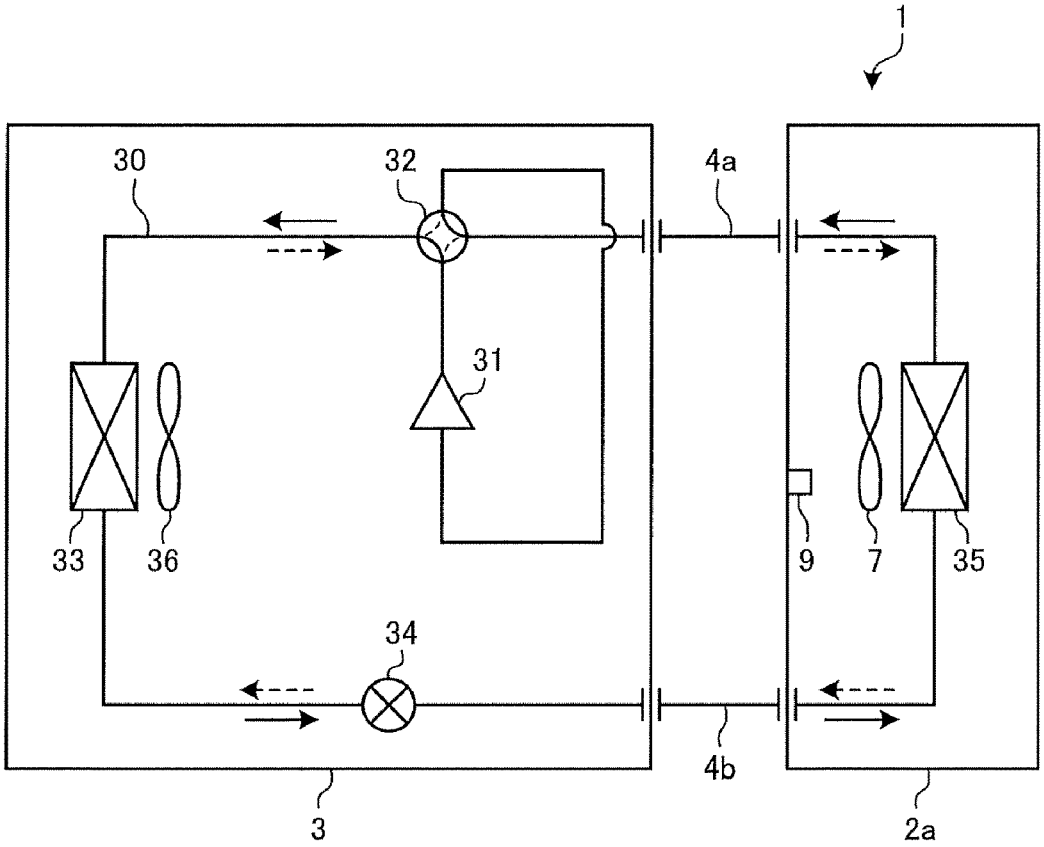
FIG. 3 is a schematic diagram illustrating a refrigerant circuit of the air-conditioning apparatus according to Embodiment 1 of the present disclosure.

FIG. 3 is a schematic diagram illustrating a refrigerant circuit of the air-conditioning apparatus 1 according to Embodiment 1 of the present disclosure. As illustrated in FIG. 3, the air-conditioning apparatus 1 performs air conditioning, by heating or cooling the room through transfer of heat between the outside air and the indoor air via refrigerant. The air-conditioning apparatus 1 includes the outdoor unit 3 and the indoor units 2*a* and 2*b*. Note that since the indoor units 2*a* and 2*b* have the same configuration, only one of the indoor units 2*a* and 2*b* will be illustrated and described for purposes of convenience.

In the air-conditioning apparatus 1, the outdoor unit 3 and each of the indoor units 2*a* and 2*b* are connected via the refrigerant pipes 4*a* and 4*b* to form a refrigerant circuit 30 in which refrigerant circulates. In the refrigerant circuit 30 of the air-conditioning apparatus 1, a compressor 31, a flow switching device 32, an outdoor heat exchanger 33, an expansion valve 34, and an indoor heat exchanger 35 are connected via the refrigerant pipes 4*a* and 4*b*.

The outdoor unit 3 includes the compressor 31, the flow switching device 32, the outdoor heat exchanger 33, and the expansion valve 34. The compressor 31 compresses the suctioned refrigerant and discharges the compressed refrigerant. The compressor 31 may include an inverter device, and may be configured such that the inverter device changes the operating frequency, thereby changing the capacity of the compressor 31. Note that the capacity of the compressor 31 is the amount of refrigerant discharged therefrom per unit time. The flow switching device 32 is, for example, a four-way valve, and is configured to switch directions in which refrigerant flows.

The air-conditioning apparatus 1 switches the flow directions of refrigerant using the flow switching device 32 in response to an instruction from the controller 13 (FIG. 1), thereby performing a heating operation or a cooling operation. The outdoor heat exchanger 33 exchanges heat between refrigerant and outdoor air. During a heating operation, the outdoor heat exchanger 33 serves as an evaporator. Specifically, the outdoor heat exchanger 33 exchanges heat between the low-pressure refrigerant having flowed from the refrigerant pipe 4*b* and outdoor air to evaporate and gasify the refrigerant, and discharges the refrigerant toward the refrigerant pipe 4*a*. During a cooling operation, the outdoor heat exchanger 33 serves as a condenser. Specifically, the outdoor heat exchanger 33 exchanges heat between the refrigerant compressed by the compressor 31 and having flowed from the flow switching device 32 side and outdoor air to condense and liquefy the refrigerant. The outdoor heat exchanger 33 is provided with an outdoor air-sending device 36 to increase the heat exchange efficiency between refrigerant and outdoor air. An inverter device may be attached to the outdoor air-sending device 36 to change the operating frequency of a fan motor and thereby change the rotation speed of the fan. The expansion valve 34 is an expansion device (flow rate control means) that serves as an expansion valve by adjusting the flow rate of refrigerant flowing through the expansion valve 34. The expansion valve 34 adjusts the pressure of refrigerant by changing the opening degree. For example, if the expansion valve 34 is an electronic expansion valve, the opening degree is adjusted based on an instruction from the controller 13 (FIG. 1) or other units.

Each of the indoor units 2*a* and 2*b* includes the indoor heat exchanger 35 configured to exchange heat between refrigerant and indoor air, and the air-sending device 7 configured to adjust the flow of air to be subjected to heat exchange by the indoor heat exchanger 35. Each of the indoor units 2*a* and 2*b* further includes the refrigerant sensor 9 configured to detect refrigerant leakage used in the refrigerant circuit 30.

During a heating operation, the indoor heat exchanger 35 serves as a condenser to exchange heat between the refrigerant having flowed from the refrigerant pipe 4*a* and indoor air, condense and liquefy the refrigerant, and discharge the refrigerant toward the refrigerant pipe 4*b*. During a cooling operation, the indoor heat exchanger 35 serves as an evaporator to exchange heat between the refrigerant decompressed by the expansion valve 34 and outdoor air, evaporate and gasify the refrigerant through removal of heat from the air, and discharge the refrigerant toward the refrigerant pipe 4*a*. The operation speed of the air-sending device 7 is specified by the user's setting. An inverter device may be attached to the air-sending device 7 to change the operating frequency of a fan motor and thereby change the rotation speed of the fan.

<Exemplary Operations of Cooling and Heating Operations of Air-Conditioning Apparatus 1>

The following describes an exemplary operation of a cooling operation of the air-conditioning apparatus 1. High-temperature high-pressure gas refrigerant compressed by the compressor 31 is discharged therefrom to flow into the outdoor heat exchanger 33 via the flow switching device 32. The gas refrigerant that has flowed into the outdoor heat exchanger 33 is condensed through heat exchange with outside air sent by the outdoor air-sending device 36 to become low-temperature refrigerant. Then, the refrigerant is discharged from the outdoor heat exchanger 33. The refrigerant discharged from the outdoor heat exchanger 33 is expanded and decompressed by the expansion valve 34 to become low-temperature low-pressure two-phase gas-liquid refrigerant. The two-phase gas-liquid refrigerant flows into the indoor heat exchanger 35 of each of the indoor units 2*a* and 2*b*, and evaporates through heat exchange with indoor air sent by the air-sending device 7 to become low-temperature low-pressure gas refrigerant. Then, the refrigerant is discharged from the indoor heat exchanger 35. The indoor air cooled through heat removal by the refrigerant is discharged as conditioned air (discharged air) from each of the indoor units 2*a* and 2*b* into the air-conditioned space, namely, the room E (FIG. 2). The gas refrigerant discharged from the indoor heat exchanger 35 is suctioned into the compressor 31 via the flow switching device 32, and compressed again. The cooling operation of the air-conditioning apparatus 1 is performed by repeating the operations described above.

The following describes an exemplary operation of a heating operation of the air-conditioning apparatus 1. High-temperature high-pressure gas refrigerant compressed by the compressor 31 is discharged therefrom to flow into the indoor heat exchanger 35 of the indoor units 2*a* and 2*b* via the flow switching device 32. The gas refrigerant that has flowed into the indoor heat exchanger 35 is condensed through heat exchange with indoor air sent by the air-sending device 7 to become low-temperature refrigerant. Then, the refrigerant is discharged from the indoor heat exchanger 35. The indoor air heated by the heat received from the gas refrigerant is discharged as conditioned air (discharged air) from each of the indoor units 2*a* and 2*b* into the room E (FIG. 2). The refrigerant discharged from the indoor heat exchanger 35 is expanded and decompressed by the expansion valve 34 to become low-temperature low-pressure two-phase gas-liquid refrigerant. The two-phase gas-liquid refrigerant flows into the outdoor heat exchanger 33 of the outdoor unit 3, and evaporates through heat exchange with outside air sent by the outdoor air-sending device 36 to become low-temperature low-pressure gas refrigerant. Then, the refrigerant is discharged from the outdoor heat exchanger 33. The gas refrigerant discharged from the outdoor heat exchanger 33 is suctioned into the compressor 31 via the flow switching device 32, and compressed again. The heating operation of the air-conditioning apparatus 1 is performed by repeating the operations described above.

Advantageous Effects of Embodiment 1

As described above, according to the air-conditioning apparatus 1 of Embodiment 1, when refrigerant leakage is detected by the refrigerant sensor 9, the controller 13 controls the display unit 10 and the speaker 11 to provide a notification of occurrence of refrigerant leakage. Also, the controller 13 controls the external terminal device 20 via the communication unit 15 to provide the notification of occurrence of refrigerant leakage. With this configuration, according to the air-conditioning apparatus 1 of Embodiment 1, a warning notification of refrigerant leakage can be provided not only from the display unit 10 and the speaker 11 disposed on the decorative panel 5 of each of the indoor units 2*a* and 2*b*, but also from the external terminal device 20. This makes it possible to attract more attention to the notification even from a user not in the vicinity of either of the indoor units 2*a* and 2*b* such that the user easily notices the notification and becomes fully aware of the refrigerant leakage.

Further, it is preferable that the controller 13 controls the display unit 10 and the speaker 11 such that the form in which the notification of occurrence of refrigerant leakage is provided differently in the indoor unit 2*a* (2*b*) in which leakage of the refrigeration is detected by the refrigerant sensor 9 from the other indoor unit 2*b* (2*a*). This makes it possible to provide the notification in a form such that the indoor unit 2*a* (2*b*) with refrigerant leakage is differentiated from the other indoor unit 2*b* (2*a*), and to easily identify the indoor unit 2*a* (2*b*) with refrigerant leakage when performing maintenance.

Modifications

The decorative panel 5 of each of the indoor units 2*a* and 2*b* in other embodiments of the present disclosure will now be described with reference to FIGS. 4 to 10. Note that the following describes the arrangement of the display unit 10, the speaker 11, the light receiving unit 17, and the human sensor 18 on the decorative panel 5. The configuration other than this is the same as that in Embodiment 1 described above, and therefore the same description will not be repeated.

Figure 4:
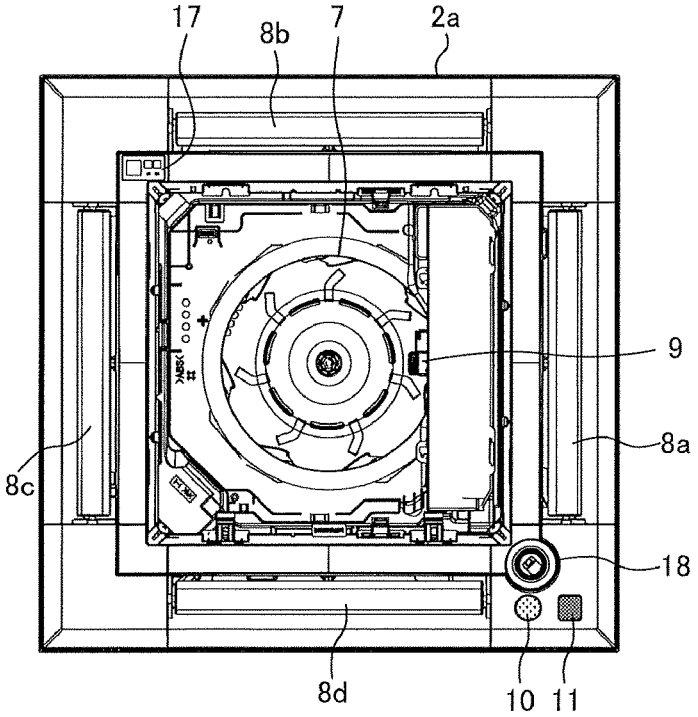
FIG. 4 is a plan view illustrating an indoor unit of an air-conditioning apparatus according to another embodiment of the present disclosure.

FIG. 4 is a plan view illustrating an indoor unit of an air-conditioning apparatus according to another embodiment of the present disclosure. In this embodiment, the light receiving unit 17 and the human sensor 18 are disposed on a diagonal line, and the display unit 10 and the speaker 11 are disposed adjacent to the human sensor 18, on the decorative panel 5. With this arrangement, when providing a notification of refrigerant leakage, light from the display unit 10 and sound from the speaker 11 are emitted side by side. This allows to attract more attention from the user. Moreover, since the display unit 10, the speaker 11, and the human sensor 18 are disposed adjacent to each other, it is easy to replace parts when performing maintenance. This improves the serviceability.

Figure 5:
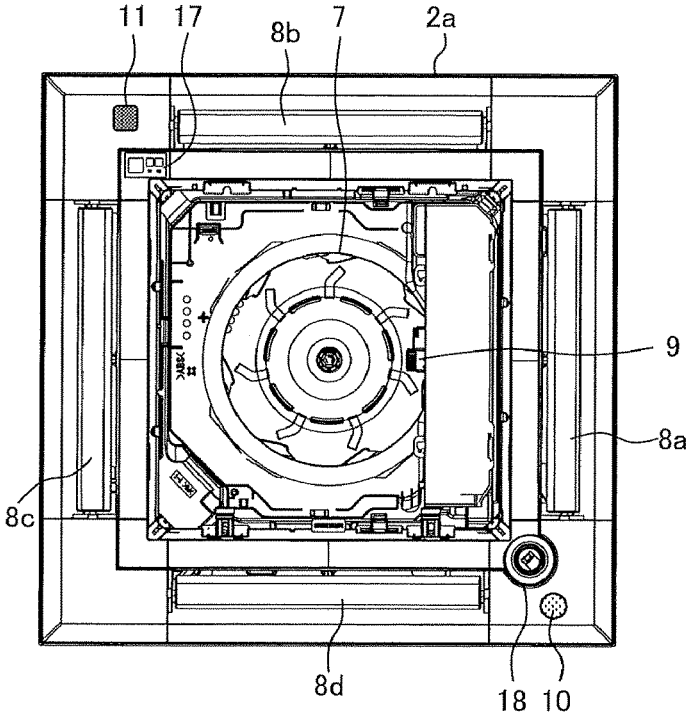
FIG. 5 is a plan view illustrating an indoor unit of an air-conditioning apparatus according to another embodiment of the present disclosure.

FIG. 5 is a plan view illustrating an indoor unit of an air-conditioning apparatus according to another embodiment of the present disclosure. In this embodiment, the light receiving unit 17 and the human sensor 18 are disposed on a diagonal line; the display unit 10 is disposed adjacent to the human sensor 18; and the speaker 11 is disposed adjacent to the light receiving unit 17, on the decorative panel 5. With this arrangement, light from the display unit 10 and sound from the speaker 11 are apart from each other on a diagonal line, and therefore are emitted in a diffused manner when providing a notification of leakage of refrigerant. This allows to attract more attention from the user. Moreover, since the display unit 10 and the human sensor 18 are disposed adjacent to each other, and since the speaker 11 and the light receiving unit 17 are disposed adjacent to each other, it is easy to replace parts when performing maintenance. This improves the serviceability.

Figure 6:
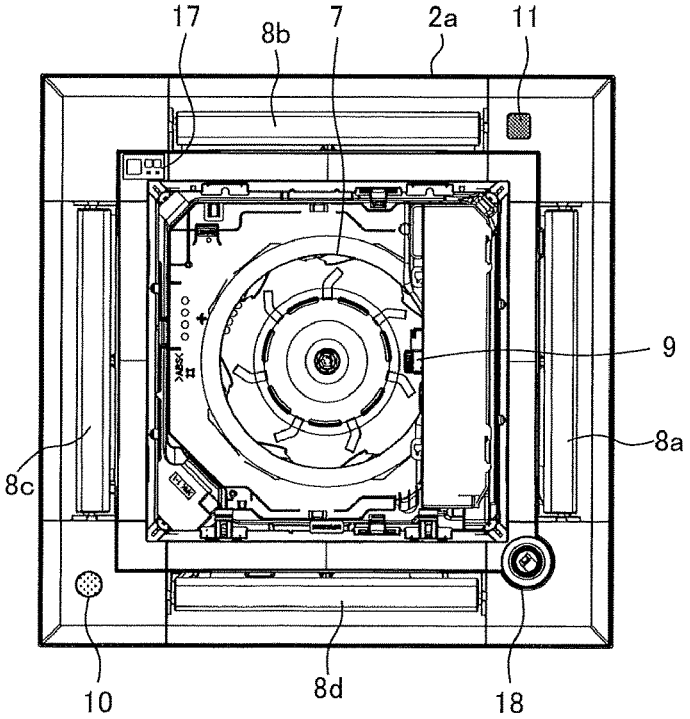
FIG. 6 is a plan view illustrating an indoor unit of an air-conditioning apparatus according to another embodiment of the present disclosure.

FIG. 6 is a plan view illustrating an indoor unit of an air-conditioning apparatus according to another embodiment of the present disclosure. In this embodiment, the light receiving unit 17 and the human sensor 18 are disposed on a diagonal line, and the display unit 10 and the speaker 11 are disposed on another diagonal line orthogonal thereto, on the decorative panel 5. That is, the display unit 10, the speaker 11, the light receiving unit 17, and the human sensor 18 are all disposed apart from each other, on the decorative panel 5. With this arrangement, light from the display unit 10 and sound from the speaker 11 are apart from each other on a diagonal line, and therefore are emitted in a diffused manner when providing a notification of refrigerant leakage. This allows to attract more attention from the user. Moreover, since the display unit 10 and the speaker 11 are disposed apart from the human sensor 18, it is possible to prevent an error in temperature detection by the human sensor 18 due to the heat generated by the display unit 10 and the speaker 11.

Figure 7:
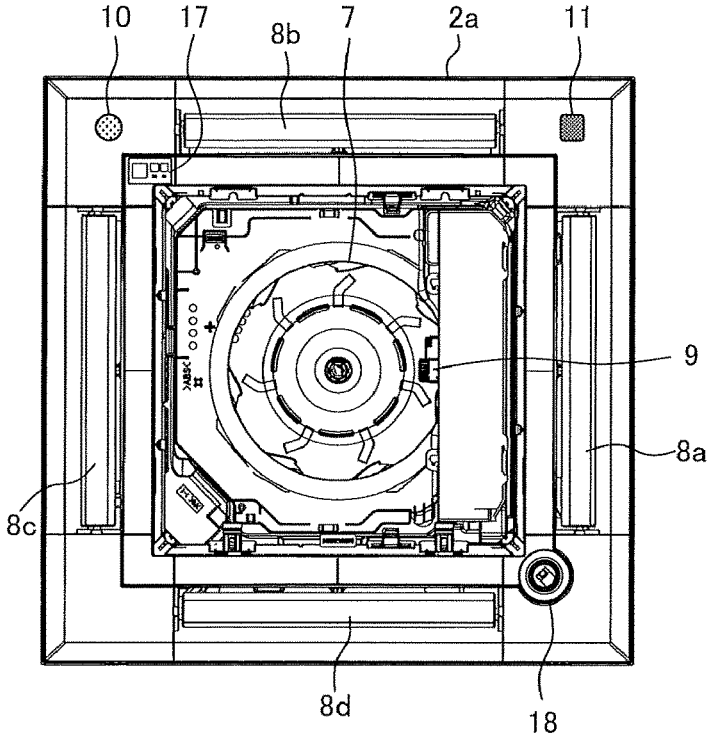
FIG. 7 is a plan view illustrating an indoor unit of an air-conditioning apparatus according to another embodiment of the present disclosure.

FIG. 7 is a plan view illustrating an indoor unit of an air-conditioning apparatus according to another embodiment of the present disclosure. In this embodiment, the light receiving unit 17 and the human sensor 18 are disposed on a diagonal line; the display unit 10 is disposed adjacent to the light receiving unit 17; and the speaker 11 is disposed apart from the light receiving unit 17 and the human sensor 18, on the decorative panel 5. With this arrangement, when providing a notification of refrigerant leakage, light from the display unit 10 and sound from the speaker 11 are apart from each other and emitted in a diffused manner. This allows to attract more attention from the user. Moreover, since the display unit 10 and the light receiving unit 17 are disposed adjacent to each other, it is easy to replace parts when performing maintenance. This improves the serviceability. Moreover, since the display unit 10, the speaker 11, and the light receiving unit 17 are disposed apart from the human sensor 18, it is possible to prevent an error in temperature detection by the human sensor 18 due to the heat generated by the display unit 10 and the speaker 11.

Figure 8:
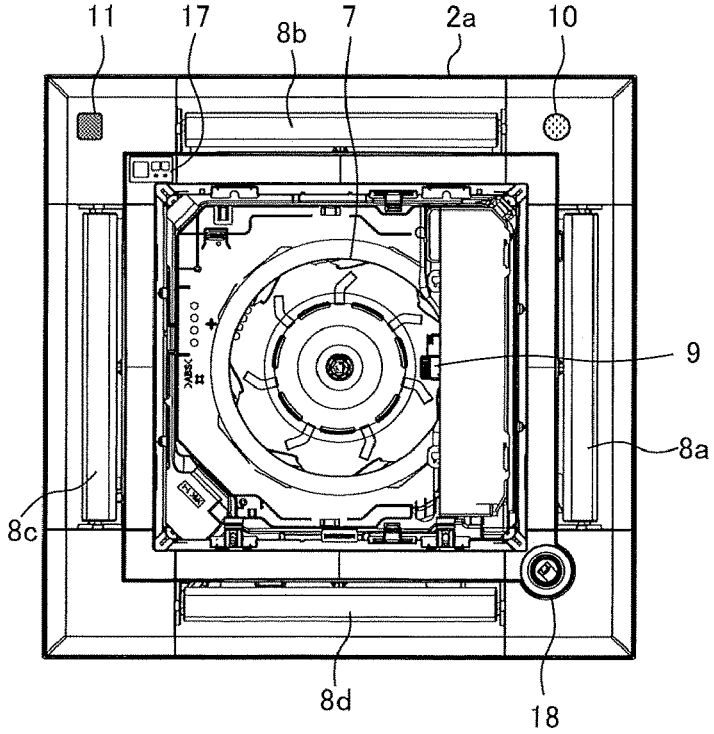
FIG. 8 is a plan view illustrating an indoor unit of an air-conditioning apparatus according to another embodiment of the present disclosure.

FIG. 8 is a plan view illustrating an indoor unit of an air-conditioning apparatus according to another embodiment of the present disclosure. In this embodiment, the light receiving unit 17 and the human sensor 18 are disposed on a diagonal line; the speaker 11 is disposed adjacent to the light receiving unit 17; and the display unit 10 is disposed apart from the light receiving unit 17 and the human sensor 18, on the decorative panel 5. With this arrangement, when providing a notification of refrigerant leakage, light from the display unit 10 and sound from the speaker 11 are apart from each other and emitted in a diffused manner. This allows to attract more attention from the user. Moreover, since the speaker 11 and the light receiving unit 17 are disposed adjacent to each other, it is easy to replace parts when performing maintenance. This improves the serviceability. Moreover, since the display unit 10, the speaker 11, and the light receiving unit 17 are disposed apart from the human sensor 18, it is possible to prevent an error in temperature detection by the human sensor 18 due to the heat generated by the display unit 10 and the speaker 11.

Figure 9:
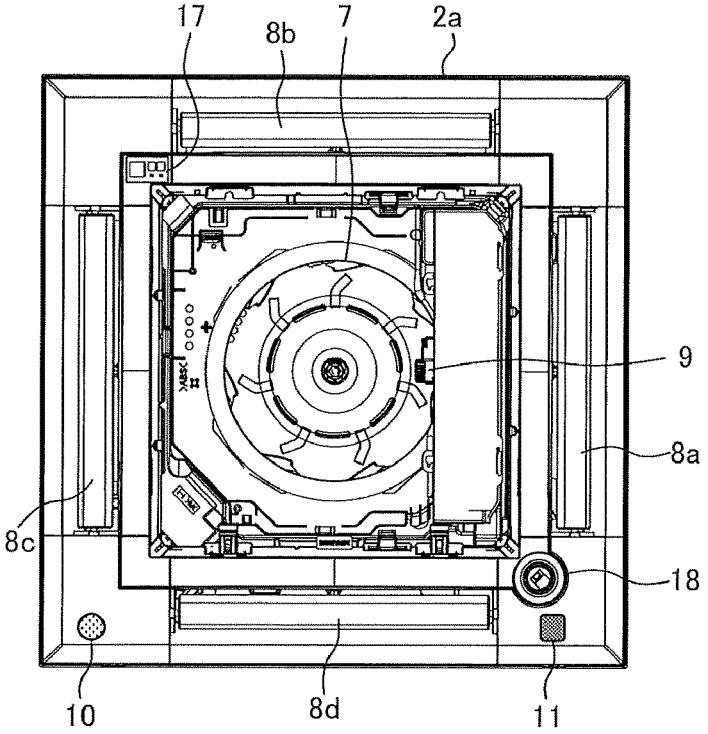
FIG. 9 is a plan view illustrating an indoor unit of an air-conditioning apparatus according to another embodiment of the present disclosure.

FIG. 9 is a plan view illustrating an indoor unit of an air-conditioning apparatus according to another embodiment of the present disclosure. In this embodiment, the light receiving unit 17 and the human sensor 18 are disposed on a diagonal line; the speaker 11 is disposed adjacent to the human sensor 18; and the display unit 10 is disposed apart from the light receiving unit 17 and the human sensor 18, on the decorative panel 5. With this arrangement, when providing a notification of refrigerant leakage, light from the display unit 10 and sound from the speaker 11 are apart from each other and emitted in a diffused manner. This allows to attract more attention from the user. Moreover, since the speaker 11 and the human sensor 18 are disposed adjacent to each other, it is easy to replace parts when performing maintenance. This improves the serviceability.

Figure 10:
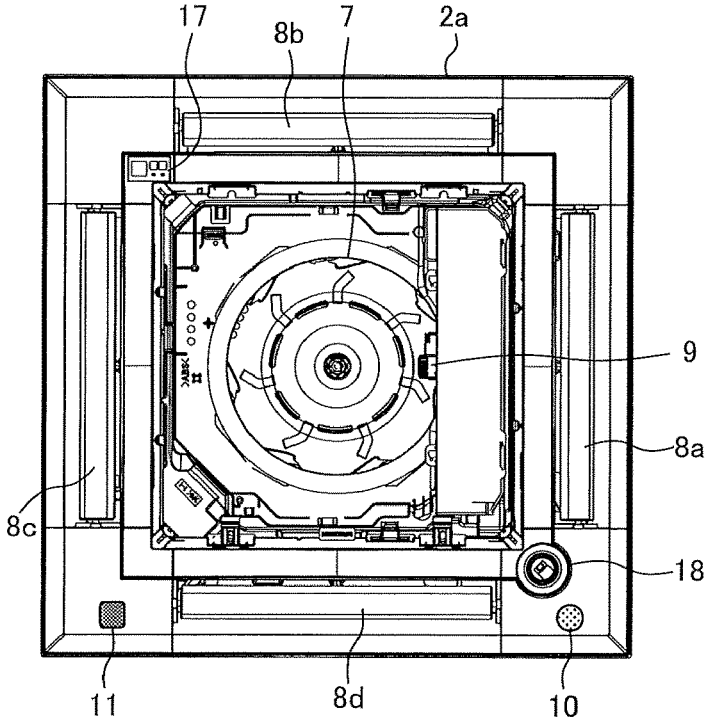
FIG. 10 is a plan view illustrating an indoor unit of an air-conditioning apparatus according to another embodiment of the present disclosure.

FIG. 10 is a plan view illustrating an indoor unit of an air-conditioning apparatus according to another embodiment of the present disclosure. In this embodiment, the light receiving unit 17 and the human sensor 18 are disposed on a diagonal line; the display unit 10 is disposed adjacent to the human sensor 18, and the speaker 11 is disposed apart from the light receiving unit 17 and the human sensor 18, on the decorative panel 5. With this arrangement, when providing a notification of refrigerant leakage, light from the display unit 10 and sound from the speaker 11 are apart from each other and emitted in a diffused manner. This allows to attract more attention from the user. Moreover, since the display unit 10 and the human sensor 18 are disposed adjacent to each other, it is easy to replace parts when performing maintenance. This improves the serviceability.

REFERENCE SIGNS LIST

1 air-conditioning apparatus 2*a* indoor unit 2*b* indoor unit 3 outdoor unit 4*a*, 4*b* refrigerant pipe 5 decorative panel 6 air inlet 7 air-sending device 8*a*, 8*b*, 8*c*, 8*d* louver 9 refrigerant sensor 10 display unit 11 speaker remote controller 13 controller 14 wire 15 communication unit 16 remote controller 17 light receiving unit 18 human sensor 19 shutoff valve 20 terminal device 30 refrigerant circuit 31 compressor 32 flow switching device outdoor heat exchanger 34 expansion valve 35 indoor heat exchanger 36 outdoor air-sending device E room R ceiling surface

The invention claimed is:

1. An air-conditioning apparatus provided with an indoor unit and an outdoor unit connected to each other via a refrigerant pipe through which refrigerant flows, the air-conditioning apparatus comprising:

a refrigerant sensor configured to detect leakage of the refrigerant in the indoor unit;

a notification unit configured to provide a notification of occurrence of leakage of the refrigerant;

a transmitter capable of communicating with an external terminal via a network; and a controller configured to control operations of the indoor unit, and to control at least the notification unit and the transmitter;

wherein the notification unit includes at least one of a display and a speaker disposed on a surface of a casing of the indoor unit;

wherein at least one of the display and the speaker disposed on the surface of the casing of the indoor unit is disposed adjacent to at least one of a temperature sensor and a light receiver disposed on the surface of the casing, the light receiver being configured to receive an operation signal from a remote controller; and wherein the controller is configured to determine whether leakage of the refrigerant is detected by the refrigerant sensor, and in response to determining that leakage of the refrigerant is detected, control both the notification unit to provide a notification of occurrence of leakage of the refrigerant and the transmitter to provide the notification of occurrence of leakage of the refrigerant via the network to the external terminal.

2. The air-conditioning apparatus of claim 1, wherein the transmitter is provided in the remote controller.

3. The air-conditioning apparatus of claim 1, further comprising:

a shutoff valve disposed at the refrigerant pipe, and configured to cut off a flow of the refrigerant between the indoor unit and the outdoor unit;

wherein in response to determining that leakage of the refrigerant is detected by the refrigerant sensor, the controller switches the shutoff valve from an open state to a closed state.

4. The air-conditioning apparatus of claim 1, wherein in response to determining that leakage of the refrigerant is detected by the refrigerant sensor, the controller forcibly operates a fan of the indoor unit.

5. The air-conditioning apparatus of claim 1, wherein the indoor unit includes a plurality of indoor units; and wherein the controller controls the notification unit such that a form in which the notification of occurrence of refrigerant leakage is provided differently in one of the plurality of indoor units in which leakage of the refrigeration is detected by the refrigerant sensor from other of the plurality of indoor units.

6. The air-conditioning apparatus of claim 1, wherein the indoor unit includes a plurality of indoor units; and wherein the controller is further configured to control the plurality of indoor units.

7. An air-conditioning apparatus provided with an indoor unit and an outdoor unit connected to each other via a refrigerant pipe through which refrigerant flows, the air-conditioning apparatus comprising:

a refrigerant sensor configured to detect leakage of the refrigerant in the indoor unit;

a notification unit configured to provide a notification of occurrence of leakage of the refrigerant;

a transmitter capable of communicating with an external terminal via a network; and a controller configured to control operations of the indoor unit, and to control at least the notification unit and the transmitter;

wherein the notification unit includes at least one of a display disposed on a surface of a casing of the indoor unit and a speaker disposed on the surface of the casing of the indoor unit;

wherein at least one of the display and the speaker disposed on the surface of the casing of the indoor unit is apart from at least one of a temperature sensor and a light receiver disposed on the surface of the casing, the light receiver being configured to receive an operation signal having indoor unit settings from a remote controller, and wherein the controller is configured to determine whether leakage of the refrigerant is detected by the refrigerant sensor, and in response to determining that leakage of the refrigerant is detected, control both the notification unit to provide a notification of occurrence of leakage of the refrigerant and the transmitter to provide the notification of occurrence of leakage of the refrigerant via the network to the external terminal.

8. The air-conditioning apparatus of claim 7, wherein the transmitter is provided in the remote controller.

9. The air-conditioning apparatus of claim 7, further comprising:

a shutoff valve disposed at the refrigerant pipe, and configured to cut off a flow of the refrigerant between the indoor unit and the outdoor unit;

wherein in response to determining that leakage of the refrigerant is detected by the refrigerant sensor, the controller switches the shutoff valve from an open state to a closed state.

10. The air-conditioning apparatus of claim 7, wherein in response to determining that leakage of the refrigerant is detected by the refrigerant sensor, the controller forcibly operates a fan of the indoor unit.

11. The air-conditioning apparatus of claim 7, wherein the indoor unit includes a plurality of indoor units; and wherein the controller controls the notification unit such that a form in which the notification of occurrence of refrigerant leakage is provided differently in one of the plurality of indoor units in which leakage of the refrigeration is detected by the refrigerant sensor from other of the plurality of indoor units.

12. The air-conditioning apparatus of claim 7, wherein the indoor unit includes a plurality of indoor units; and wherein the controller is further configured to control the plurality of indoor units.

* * * * *